United States Patent [19]

Frisbee et al.

[11] 4,352,626

[45] Oct. 5, 1982

[54] LOADER ARM POSITIONING DEVICE

[75] Inventors: Claude M. Frisbee, Bettendorf; David H. Seaberg, Davenport, both of Iowa

[73] Assignee: J. I. Case Company, Racine, Wis.

[21] Appl. No.: 219,077

[22] Filed: Dec. 22, 1980

[51] Int. Cl.[3] ..... B66C 23/00

[52] U.S. Cl. ..... 414/722; 92/15; 172/466; 298/17 B

[58] Field of Search ..... 414/694, 722, 713; 298/17 B; 172/466, 481; 187/8.47, 8.49; 92/15, 17, 19; 212/238, 261

[56] References Cited

U.S. PATENT DOCUMENTS

| | | | |
|---|---|---|---|
| 3,477,518 | 11/1969 | Walker et al. | 172/466 X |
| 3,982,648 | 9/1976 | Luedtke et al. | 414/713 X |
| 4,039,093 | 8/1977 | Schmitz et al. | 414/713 X |

*Primary Examiner*—Robert J. Spar
*Assistant Examiner*—Donald W. Underwood
*Attorney, Agent, or Firm*—Cullen, Sloman, Cantor, Grauer, Scott & Rutherford

[57] ABSTRACT

A locking member is disclosed that is selectively operable to secure the loader boom arms in a raised position for service or repair. The locking member is pivotally connected to a boom arm for movement to an operative position between the boom arm and its respective lift cylinder where it is restrained in compression between the boom arm and lift cylinder to latch the boom arm in a raised position against collapsing movement. The locking member includes a pair of spaced apart, parallel, and aligned mounting plates, each being generally in the form of a right triangle and a generally U-shaped yoke fixed between the mounting plates and extending along opposed corresponding sides of the mounting plates for a part of their length. In the inoperative position of the locking member, one side of the generally U-shaped yoke is held in a substantially abutting relationship with the underside of the boom arm such that the locking member is out of the way where it will not interfere with the normal operation of the boom arm. The locking member is movable to an operative position where the U-shaped yoke abuts against the end of the lift cylinder and straddles the lift cylinder piston rod thereby providing a rigid strut between the lift cylinder and boom arm to support the boom arm in its raised position against collapsing movement.

1 Claim, 4 Drawing Figures

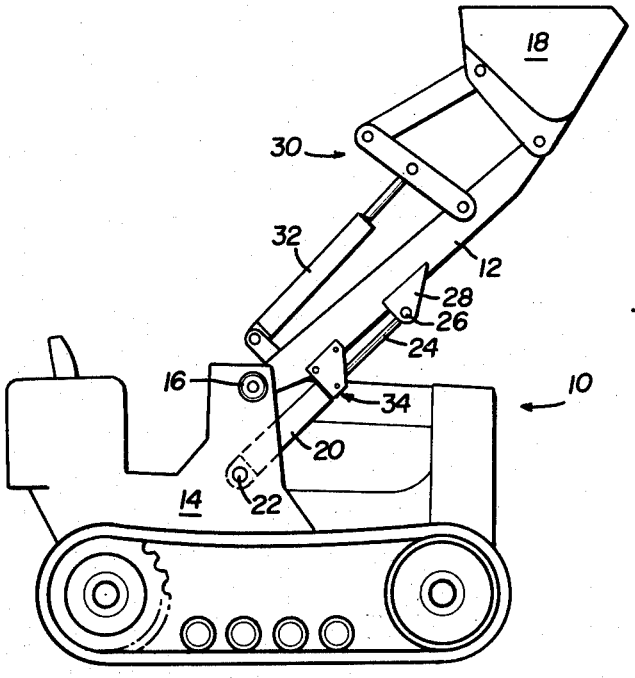
FIG. 1
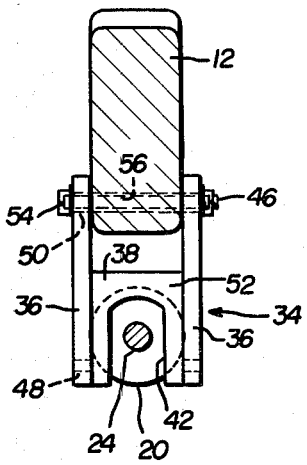
FIG. 4
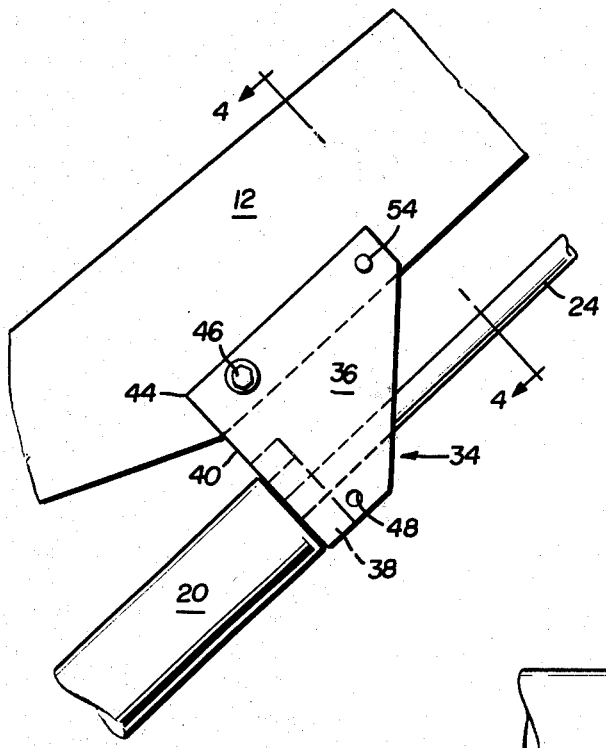
FIG. 2
FIG. 3
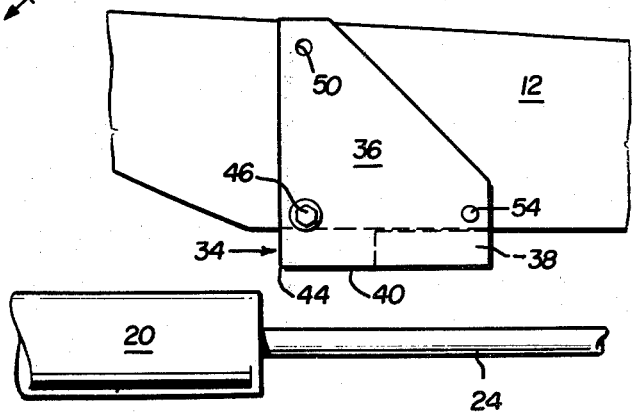

LOADER ARM POSITIONING DEVICE

BACKGROUND OF THE INVENTION

The present invention relates to a locking arrangement for the boom arms on a bucket loader, and more particularly, to a locking member that is selectively operable to secure the boom arms in a raised position for service or repair.

It is conventional to provide a tractor carrying a front end mounted bucket assembly including a boom frame, bucket linkage, and hydraulic cylinders for actuating the bucket assembly components. Various constructions have been developed for immobilizing the bucket and its associated linkage for service and repair such that the boom arms are secured thereby permitting the operator to inspect the work area beneath the bucket, grease fittings, check hose connections and the like. The present invention provides an improved locking means for immobilizing the bucket linkage in a given position with respect to the tractor.

It is an object of the present invention to provide a locking device for upwardly supporting the bucket boom arms in a position where, because of mechanical advantage, the locking device cannot be overridden.

It is another object to provide a locking device that is readily and easily positioned out of the way into a stored or inoperative position such that it will not interfere with the normal operation of the boom arms while still being accessible and easily movable into an operative or supporting position.

SUMMARY OF THE INVENTION

In accordance with the present invention, an improved locking device is provided for front end bucket loaders for securing the bucket boom arms in an immobile position with respect to a tractor. The bucket boom arms are pivotally secured to the tractor on opposite sides of its frame for swinging movement parallel to a longitudinal vertical plane. The bucket boom arms are raised and lowered by lift cylinders which are pivotally connected between the tractor frame and the underside of the boom arms. The locking device of the present invention is pivotally connected to one or both boom arms and may be movable to an operative position between a boom arm and an extended lift cylinder where it is restrained in compression between the boom arm and lift cylinder to latch the boom arm in a raised position against collapsing movement.

The locking device assembly includes a pair of spaced apart, parallel, and aligned mounting plates, each being generally in the form of a right triangle. A generally U-shaped yoke is fixed between and extends along opposed corresponding sides of the mounting plates for a part of their length. The open portion of the U-shaped yoke extends outwardly away from the right angle corners of the mounting plates. The mounting plates are pivotally attached to opposite sides of a boom arm by a pivot pin that extends through opposed openings adjacent the right angle corners of the plates. Each mounting plate also includes additional openings adjacent its other corners for securing the locking device assembly to the boom arm in both operative and inoperative positions.

In the inoperative position of the locking device, one side of the generally U-shaped yoke is held in a substantially abutting relationship with the underside of the boom arm and the side surfaces of the mounting plates are substantially held in alignment with opposite sides of the boom arm which is sandwiched therebetween. Thus, the locking device is out of the way where it will not interfere with the normal operation of the boom arm. The locking device is held in its inoperative position by a lock pin that passes through a latch opening in the boom arm and through a first set of opposed openings in the mounting plates adjacent the U-shaped yoke.

The locking device is selectively movable to an operative position after extending the boom arm lift cylinder, releasing the lock pin from the latch opening in the boom arm, and then rotating the locking device downwardly such that the U-shaped yoke abuts against the end of the lift cylinder and straddles the lift cylinder piston rod. The lock pin is then reinserted into the boom arm latch opening through a second set of opposed openings through the mounting plates for holding the locking device in its operative position thereby providing a rigid strut between the lift cylinder and boom arm. In this position, a compression force is created between the boom arm lock pin and U-shaped yoke to support the boom arm in its raised position against collapsing movement.

Thus, the present invention provides a locking device for a boom arm for holding the arm in a raised position while the operator inspects or services the bucket assembly. The locking device is simplified in construction and arrangement and readily accessible to the operator for positioning in either operative or inoperative locations.

Other advantages and meritorious features of the locking device of the present invention will be more fully understood from the following description of the preferred embodiment, the appended claims, and the drawings, a brief description of which follows.

BRIEF DESCRIPTION OF DRAWINGS

FIG. 1 is a side elevational view of a tractor carrying a front end bucket loader assembly equipped with the locking device of the present invention.

FIG. 2 is a partial side elevational view illustrating the locking device in its operative position between the boom arm and lift cylinder.

FIG. 3 is a partial side elevational view illustrating the locking device in its inoperative position.

FIG. 4 is a cross-sectional view taken along line 4—4 in FIG. 2.

DETAILED DESCRIPTION OF THE INVENTION

A preferred embodiment of a tractor carrying a front end bucket loader assembly including the locking device made in accordance with the teachings of the present invention is illustrated in FIGS. 1–4.

The tractor 10 includes conventional boom arms 12 which are pivotally mounted on opposite sides of tractor frame 14 by pivot pins 16. The outer ends of boom arms 12 are pivotally connected to a bucket 18. The boom arms 12 are raised and lowered by lift cylinders 20 which are pivotally connected to opposite sides of frame 14 by pivot pins 22 such that each lift cylinder 20 is disposed directly beneath a corresponding boom arm 12 and in the vertical plane thereof. The lift cylinder piston rods 24 are connected by pins 26 to lug plates 28 which are fixed to the boom arms 12. A tilt linkage 30 including a tilt cylinder 32 is provided for varying the attitude of the bucket 18 about its pivotal connection with the boom arms 12. This mechanism is conventional and need not be described in further detail since it forms no part of the present invention.

The present invention relates to a locking device assembly 34 that is selectively operable to secure the boom arms 12 in a raised position as illustrated in FIG. 1 for service or repair. The locking device 34 may be movable to an operative position between the boom arm 12 and its respective lift cylinder 20, as illustrated in FIGS. 1 and 2, where it is restrained in compression between the boom arm 12 and lift cylinder 20 to latch the boom arm 12 in a raised or immobile position against collapsing movement. The locking device 34 is also readily and easily positioned out of the way into a stored or inoperative position, as illustrated in FIG. 3, such that it will not interfere with the normal operation of the boom arms 12 while still being accessible and easily movable into an operative or supporting position.

The locking device assembly 34 may be mounted to one or both boom arms 12, and it includes a pair of spaced apart, parallel, and aligned mounting plates 36, each being generally in the form of a right triangle. A generally U-shaped yoke 38 is fixed between mounting plates 36 and extends along opposed corresponding sides 40 of the mounting plates for a part of their length. The open portion 42 of the U-shaped yoke 38 extends outwardly away from the right angle corners 44 of the mounting plates 36. Mounting plates 36 are pivotally attached to opposite sides of a boom arm 12 by a pivot pin 46 that extends through opposed openings adjacent the right angle corners 44 of plates 36. Each mounting plate 36 also includes additional openings 48 and 50 adjacent its other corners for securing the locking device assembly 34 to the boom arm 12 in both operative and inoperative positions.

In the inoperative position of the locking device 34, one side 52 of the generally U-shaped yoke 38 is held in a substantially abutting relationship with the underside of the boom arm 12. In this position as illustrated in FIG. 3, the side surfaces of the mounting plates 36 are substantially held in alignment with opposite sides of the boom arm 12 which is sandwiched therebetween such that the locking device 34 is out of the way where it will not interfere with the normal operation of the boom arm 12. The locking device 34 is held in its inoperative position by a lock pin 54 that passes through a latch opening 56 in the boom arm and through a first set of opposed openings 48 through the mounting plates 36 adjacent the U-shaped yoke 38.

The locking device 34 is selectively movable to an operative position as illustrated in FIGS. 1, 2, and 4, after first extending the boom arm lift cylinder 20, releasing the lock pin 54 from the latch opening 56 through the boom arm 12, and then rotating the locking device 34 downwardly such that the U-shaped yoke 38 abuts against the end 58 of the lift cylinder 20 where it straddles the lift cylinder piston rod 24. The lock pin 54 is then reinserted into the boom arm latch opening 56 through a second set of opposed openings 50 through the mounting plates 36 for holding the locking device 34 in its operative position. In this position, the locking device 34 provides a rigid strut between the lift cylinder 20 and boom arm 12 such that a compression force is created between the boom arm 12 and U-shaped yoke 38 to support the boom arm 12 in its raised or immobile position against collapsing movement about pivot points 16 and 22.

Thus, the locking device 34 may be used for holding the boom arms 12 in an immobile position while the operator inspects or services the bucket assembly. The locking device 34 secures the boom arms 12 in a raised position where because of mechanical advantage, the locking device cannot be overriden. Further, the locking device 34 is simplified in construction and arrangement and readily accessible to the operator for positioning in either operative or inoperative locations.

It will be apparent to those skilled in the art that the foregoing disclosure is exemplary in nature rather than limiting, the invention being limited only by the appended claims.

We claim:

1. In a tractor carrying a front end mounted bucket assembly including boom arms which are pivotally secured to the tractor on opposite sides of its frame for swinging movement parallel to a longitudinal vertical plane and corresponding lift cylinders disposed directly beneath the boom arms for raising and lowering the boom arms, each lift cylinder including an end portion and a piston rod connected to its corresponding boom arm, the improvement comprising:

a locking device pivotally connected to one of said boom arms and said locking device being selectively movable between an inoperative position where the locking device is out of the way so that it will not interfere with the normal operation of the boom arm and an operative position between the boom arm and the corresponding lift cylinder for the boom arm where the locking device is restrained in compression to secure the boom arm and lift cylinder in a raised position against collapsing movement;

said locking device including a pair of spaced apart, parallel, and aligned mounting plates, each mounting plate being generally in the form of a right triangle, a generally U-shaped yoke fixed between said mounting plates and extending along opposed corresponding sides of the mounting plates for a part of their length, said yoke including an open portion that extends outwardly away from the right angle corners of the mounting plates, and said mounting plates being pivotally attached to opposite sides of said boom arm;

a lock pin passing through a first set of opposed openings in said mounting plates and a latch opening through said boom arm for holding said locking device in its inoperative position where one side of said yoke is held in a substantially abutting relationship with the underside of said boom arm and the side surfaces of said mounting plates being held in alignment with opposite sides of said boom arm which is sandwiched therebetween; and said lock pin being selectively removed and reinserted through a second set of opposed openings through said mounting plates and said boom arm latch opening such that said locking device assumes its operative position whereby said yoke abuts the end portion of said lift cylinder and straddles the lift cylinder piston rod thereby providing a rigid strut between the lift cylinder and boom arm to support the boom arm in a raised position against collapsing movement.

* * * * *